United States Patent [19]

Casey et al.

[11] 4,055,223

[45] Oct. 25, 1977

[54] CORNER TOOTH ASSEMBLY FOR AN EARTHMOVING IMPLEMENT HAVING A HOLLOW REARWARD PORTION

[75] Inventors: Thomas P. Casey, Burlington, Iowa; Howard A. Hansen, Mossville; Gene R. Klett, Joliet; James A. Olthoff, South Holland, all of Ill.

[73] Assignee: Caterpillar Tractor Co., Peoria, Ill.

[21] Appl. No.: 729,326

[22] Filed: Oct. 4, 1976

Related U.S. Application Data

[63] Continuation of Ser. No. 563,862, March 31, 1975, abandoned.

[51] Int. Cl.[2] ..... E02F 3/60; E02F 3/76

[52] U.S. Cl. ..... 172/777; 37/141 T

[58] Field of Search ..... 37/141, 142; 172/777, 172/778; 56/314, 158

[56] References Cited

U.S. PATENT DOCUMENTS

| | | | |
|---|---|---|---|
| 1,584,052 | 5/1926 | Van Buskirk | 37/142 R |
| 1,722,154 | 7/1929 | Meyer | 37/142 R |
| 2,702,490 | 2/1955 | Launder | 37/142 A X |
| 2,838,856 | 6/1958 | Buisse | 37/142 R |
| 2,914,868 | 12/1959 | Launder | 37/142 A |
| 3,049,824 | 8/1962 | McIninch | 37/142 R |
| 3,334,431 | 8/1967 | Phillips | 37/142 A |
| 3,520,076 | 7/1970 | Nichols | 172/777 X |
| 3,648,391 | 3/1972 | Kabay et al. | 37/141 T |
| 3,839,806 | 10/1974 | Hoop et al. | 37/142 R |
| 3,961,788 | 6/1976 | Helton et al. | 37/141 T |

*Primary Examiner*—Clifford D. Crowder
*Assistant Examiner*—Steven A. Bratlie
*Attorney, Agent, or Firm*—Charles E. Lanchantin, Jr.

[57] ABSTRACT

A corner tooth assembly, for an earthmoving implement having an upright sidewall and a cutting edge disposed in laterally extending relation from the sidewall, includes a corner tooth adapter having a hollow rearward portion secured to a lower forward outside surface of the sidewall and a nose portion extending forwardly of the sidewall, and a replaceable wear tip mounted on the nose portion of the adapter protectingly beyond the implement so that loads on the tip during forward movement of the implement are transmitted through the adapter directly rearwardly to the sidewall without affecting the cutting edge.

3 Claims, 4 Drawing Figures

CORNER TOOTH ASSEMBLY FOR AN EARTHMOVING IMPLEMENT HAVING A HOLLOW REARWARD PORTION

This is a continuation of Ser. No. 563,862 filed Mar. 31, 1975, now abandoned.

BACKGROUND OF THE INVENTION

Various earthmoving implements, such as bulldozer blades, buckets, scraper bowls and the like, have been extensively developed to either increase the service life of those parts subjected to high wear, or to simplify the removal and replacement thereof. For example, sectionalized cutting edges have been widely adopted so that the members thereof may be individually removed from the implement frame for replacement or servicing without the expense of replacing the entire cutting edge. It is well known that the outside leading corners of these implements are particularly prone to damage and high wear as the result of more frequent engagement with rocks, for example. Consequently, these corner members or end bits are made conveniently replaceable, as by securing them to the implement by a plurality of retaining bolts. Unfortunately, after an extended period of use the bolts and associated members deform and corrode, and are simply not easily replaceable. Representative of these end bits are U.S. Pat. No. 2,732,639 issued Jan. 31, 1956 to M. R. Lillengreen; U.S. Pat. No. 2,914,868 issued Dec. 1, 1959 to E. L. Launder; and U.S. Pat. No. 2,965,989 issued Dec. 27, 1960 to M. R. Hibbard. In order to increase the ability of these earthmoving implements to penetrate rather than to glide over hard or frozen earth, it has been found advantageous to add forwardly and downwardly extending integral adapters to the end bits along with replaceable wear tips therefor. This type of arrangement is disclosed in aforementioned U.S. Pat. No. 2,914,868. But since this adapter and end bit combination is used to penetrate harder materials, or is used more severely to pry out boulders or the like, the unit loading of the bolts increases so significantly as a result of the markedly greater leverage action thereon that they frequently fail. As a result, complex mounting systems involving more and more bolts are adopted, which only adds to the overall expense incurred. This is particularly true when extra steel is used which does not directly contribute to an extended service life of the leading wear edges thereof.

Illustrative of the wide range of efforts to overcome the above problems are U.S. Pat. No. 2,841,897 issued July 8, 1958 to E. D. Duke and U.S. Pat. 3,851,413 issued Dec. 3, 1974 to P. J. Lukavich. However, as far as is known, none of these solutions offer the corner tooth penetrating and direct force transmitting capability, the implement protecting ability, and the serviceability and service life features to which the present invention is particularly directed.

SUMMARY AND OBJECTS OF THE INVENTION

Accordingly, it is an object of the present invention to provide an improved corner tooth assembly for an earthmoving implement which is relatively strong and durable in its construction and operation, while also assuring maximum protection of the implement.

Another object of the present invention is to provide such an improved corner tooth assembly with an economical adapter and conveniently serviceable wear tip construction.

Another object is to provide a corner tooth assembly having the aforementioned characteristics, including significant penetrating and prying capabilities, while better transferring the loading forces thereon directly into the implement.

Other objects and advantages of the present invention will become more readily apparent upon reference to the accompanying drawings and the following description.

DESCRIPTION OF THE PREFERRED EMBODIMENT

Figure 1:
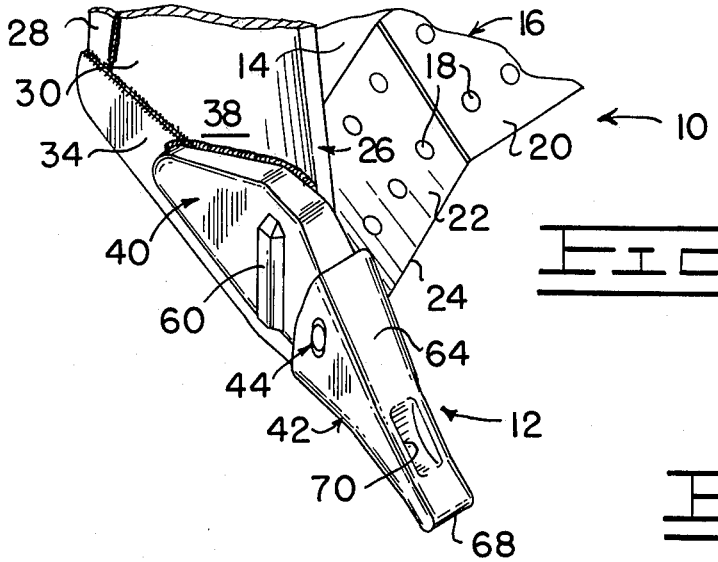
FIG. 1 is a fragmentary, oblique perspective view of a righthand front corner of an earthmoving implement showing the corner tooth assembly of the present invention thereon.

With reference to FIG. 1 of the drawings, a fragmentary righthand front corner of an earthmmoving implement 10, such as a bulldozer blade or the like, is shown as having a corner tooth assembly 12 mounted fully laterally outwardly thereon in accordance with the present invention. Although not shown, it should be appreciated that the lefthand front corner of the bulldozer blade would normally be a substantially mirror image of the righthand front corner.

Generally, the bulldozer blade 10 includes a laterally extending moldboard frame 14 and a sectionalized cutting edge 16 which is removably secured thereto as by a plurality of retaining bolts 18. The cutting edge consists of a centrally disposed and inclined blade 20 and a pair of end bits 22 (one shown) which extend obliquely laterally outwardly therefrom to jointly present a substantially coextending leading wear edge 24 forwardly and in a common plane below the frame.

Figure 2:
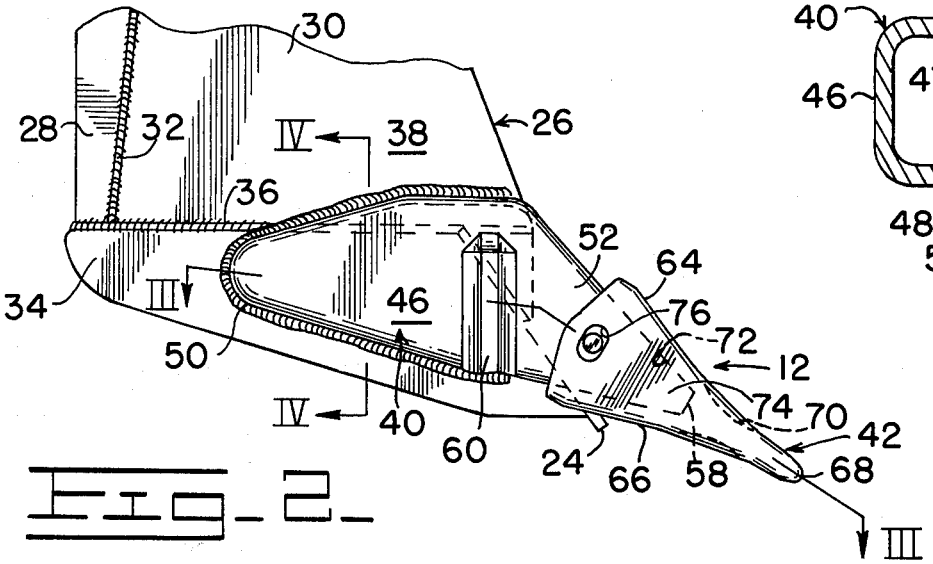
FIG. 2 is an enlarged side elevational view of the earthmoving implement and corner tooth assembly of FIG. 1.
Figure 3:
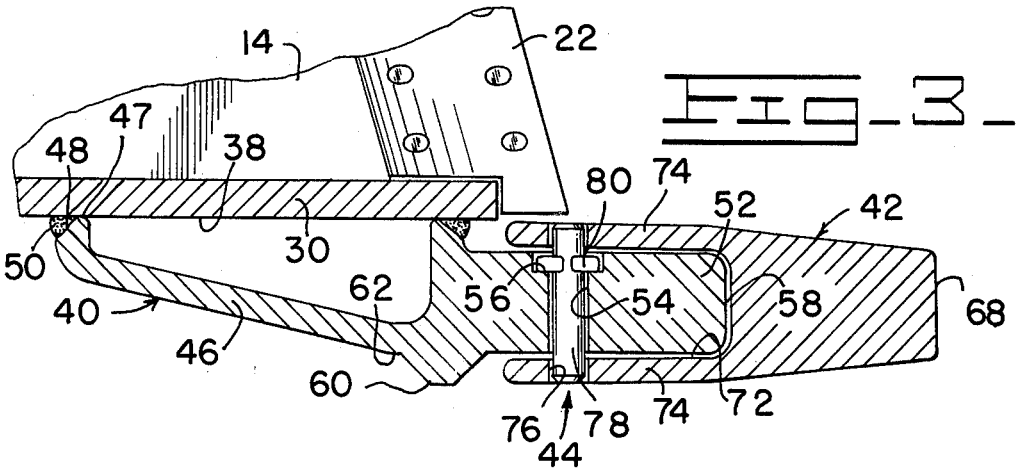
FIG. 3 is a fragmentary plan view of the earthmoving implement of FIG. 2 with the laterally outwardly extending corner tooth assembly of the present invention shown in horizontal section as taken along the line III—III of FIG. 2 to illustrate the internal structure thereof.

As may be appreciated by referring to FIGS. 1, 2, and 3, the frame 14 extends laterally outwardly to, and is integrally secured to, a sectionally fabricated upright sidewall identified generally by the reference numeral 26. The three major portions of this sidewall are an upright rear back plate 28, a front plate 30 secured to the back plate as by a weld 32, and a bottom wear plate or gusset 34 secured to the back plate and front plate as by a weld 36.

Figure 4:
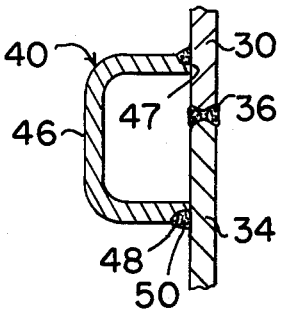
FIG. 4 is a fragmentary vertical transverse sectional view of the corner tooth assembly of the present invention as taken along the line IV—IV of FIG. 2.

In accordance with the present invention, the corner tooth assembly 12 is secured to a lower forward outside surface 38 of the fabricated sidewall 26. Specifically, the corner tooth assembly includes a formed corner tooth adapter 40, a replaceable wear tip 42, and a quick-release retainer arrangement 44 therebetween. AS best shown in FIGS. 3 and 4, the corner tooth adapter has a hollow rearward portion 46 of inwardly extending C-shaped cross section defining and inner peripheral border 47 with an exterior chamfered edge 48 thereon. Because of this construction, it is a relatively simple matter to integrally secure the adapter directly to the outside surface 38 of the sidewall as by an extensive and relatively strong peripheral weld 50.

More particularly, the formed corner tooth adapter 40 also includes a solid nose portion 52 thereon, except for a laterally extending, horizontally oriented, pin-receiving bore 54 therethrough, and a lock-receiving counterbore 56 concentric therewith. The nose portion extends convergingly forwardly and downwardly laterally outwardly of the sidewall 26 and the peripheral border 47 of the hollow rearward portion 46 of the adapter to culminate at a front face 58. Also, substantially intermediate the nose portion and the hollow rearward portion 46 of the adapter is an upright barrier or tip protecting rib 60 which extends integrally outwardly from a coextending outside surface 62 thereof.

As shown in FIGS. 1 and 2, the replaceable wear tip 42 includes an upper wear surface 64 and a lower wear surface 66 which converge in a symmetrical manner toward a leading edge 68 thereof. A recess 70 is formed in each of these wear surfaces to promote a self-sharpening capability to the wear tip for improved penetration into hard earth with extended service thereof. In the usual manner a convergingly tapered cavity or socket 72 is formed within the rear of the tip so that it may be closely received on the similarly profiled nose portion 52 of the adapter. Also, as best shown in FIG. 2, a pair of rear sidewalls 74 on the tip are individually provided with a generally elliptically sectioned aperture 76 which are disposed in laterally aligned relation with the bore 54 of the adapter.

Upon inspection of FIG. 3 it will be seen that the quick-release retainer arrangement 44 consists of a cylindrical steel retaining pin 78 which is insertably installed centrally within the pin-receiving bore 54 in the adapter 40 and within the apertures 76 of the wear tip 42. It is retained in place by a spliit ring 80 which is disposed in the counterbore 56 of the adapter and is peripherally grippingly mounted on the pin.

OPERATION

While the operation of the present invention is believed clearly apparent from the foregoing description, further amplification will subsequently be made in the following brief summary of such operation. During forward movement of the bulldozer blade 10 penetratingly through the earth, the replaceable wear tip 42 transmits loads substantially directly rearwardly upon the juxtaposed converging nose portion 52 of the adapter 40. Such significant loads are effectively transmitted by the hollow elongated rearward portion 46 of the adapter and the relatively long peripheral weld 50 to the lower forward outside surface 38 of the sidewall 26. Pursuant to the present invention, these loads are transmitted to the frame 14 of the blade without affecting the end bits 22. Also, in accordnce with one apsect of the invention, the corner tooth assembly is beneficially located in its entirety laterally outwardly of the sidewall to assure maximum protection of the blade along with providing excellent lateral and ground-engaging penetrating ability, and while still retaining strong structural integrity therebetween. As a consequence of such lateral outward extension of the corner tooth assembly, the wear rate of the sidewall is decreased.

Wear the wear tip 42 becomes worn at its elevationally lower extremity, the retaining pin 78 is driven outwardly by a hammer or the like from its gripped position within the bore 54 and the aperture 76. Then the worn tip is knocked forwardly off of the adapter and a new tip is positioned fully rearwardly in seated relation on the nose portion 52. Thereafter the retaining pin is driven laterally inwardly through the easily visually aligned bore and apertures and is tightly received and lockingly retained in its proper lateral position by the gripping split spring ring 80.

Upon inspection of FIG. 2 it may be appreciated that the front face 58 of the adapter nose portion 52 is generally disposed elevationally above the leading wear edge 24, as well as the bottom wear plate 34, so that a maximum amount of material can be worn off the wear tip without damage to the adapter 40. Note that at the point of maximum elevational wear of the tip, the wear plate 34 would present a greatly increased wear surface at its elevtionally lower extremity which would thereby serve to protect the nose portion of the adapter. Moreover, it is apparent that the front face 68 of the tip extends a substantial amount forwardly of, and slightly below the leading wear edge 24 of the blade 10 for improved penetration.

The present invention is also concerned with decreasing the possibility that the wear tip 42 might be knocked forwardly off of the adapter 40 by a rock or the like upon reverse movement of the bulldozer blade 10 and upon any failure of the retainer arrangement 44. To resolve this problem the upright barrier 60 cooperates with the forwardly and outwardly tapered rearward portion 46 of the adapter and serves to protect the rear of the tip by blocking or otherwise urging any such article laterally outwardly away therefrom.

Thus, it is clear that the improved corner tooth assembly 12 of the present invention includes a light weight, but relatively strong adapter 40, which is protectingly associated with a conveniently replaceable wear tip 42 in a manner better able to transfer loading forces from the tip directly into the sidewall 26 of the bulldozer blade 10. Also, because of the laterlly offset and longitudinally parallel relation of the wear tip with respect to the sidewall, significant penetrating and prying capabilities are realized.

While the invention has been described and shown with particular reference to a preferred embodiment, it will be apparent that the variations might be possible that would fall within the scope of the present invention, which is not intended to be limited except as defined in the following claims.

What is claimed is:

1. A corner tooth assembly, for an earthmoving implement having a predetermined forward and rearward direction of travel and having an upright sidewall disposed in a plane substantially aligned with said directions of travel and including an outer surface, comprising:

a corner tooth adapter having a hollow rear portion of laterally inwardly extending C-shaped cross section, said rear portion tapering rearwardly and convergingly towards said sidewall and defining a substantially continuous peripheral edge which is secured to a lower forward portion of said outer surface of said sidewall by a weld, and a convergingly tapered nose portion extending forwardly of said sidewall in laterally outwardly spaced relation thereto; and a socketed replaceable wear tip mounted on said nose portion of said adapter fully laterally outwardly of said outer surface of said sidewall to a location sufficient for working forces subjected on said wear tip during forward travel of the implement to be transmitted rearwardly through said adapter and thence directed solely to said outer surface of said sidewall through said weld.

2. The corner tooth assembly of claim 1 wherein said adapter has an outside surface and includes an upright tip protecting rib which extends latrally outwardly from said outside surface of said adapter and beyond said wear tip substantially intermediate said rear portion and said nose portion, said rib being of a construction sufficient for preventing said wear tip from being forced forwardly off said adapter during rearward travel of the implement.

3. A corner tooth assembly, for a bulldozer blade having a predetermined forward and rearward direction of travel, a laterally extending cutting edge, and an upright sidewall aligned with the direction of travel and including an outer surface, comprising:

a corner tooth adapter including a hollow rear portion of laterally inwardly extending C-shaped cross section which is tapered in rearwardly converging relation toward the outer surface of said sidewall, said rear portion having a substantially continuous inner peripheral border and being secured to said outer surface of said sidewall and to said border by a weld, a convergingly tapered nose portion which extends forwardly of both said sidewall and said cutting edge in spaced relation laterally outwardly away from said sidewall, and an upright protecting barrier which extends laterally outwardly beyond said adapter and is located between said rear portion and said nose portion;

a socketed wear tip removably mounted securely on said nose portion of said adapter and having a leading edge which extends below said cutting edge and forwardly of the bulldozer blade, said tip and said adapter being of a construction sufficient for transmitting working forces rearwardly and solely to said weld and said outer surface of said sidewall, said wear tip being disposed laterally inwardly of said barrier so that it is protected from being forced forwardly off said adapter during rearward travel of the blade; and quick-release retaining pin means for positively coupling said wear tip to said adapter and allowing it to be conveniently replaced.

* * * * *